US006744145B2

(12) United States Patent
Chang

(10) Patent No.: US 6,744,145 B2
(45) Date of Patent: Jun. 1, 2004

(54) FOOTWEAR WITH A POWER GENERATOR

(76) Inventor: Chih-Jung Chang, No. 7, Yung-Li 2nd St., Chia-Yi City, Chia-Yi Hsien (TW)

( * ) Notice: Subject to any disclaimer, the term of this patent is extended or adjusted under 35 U.S.C. 154(b) by 135 days.

(21) Appl. No.: 10/144,275

(22) Filed: May 10, 2002

(65) Prior Publication Data

US 2003/0208933 A1 Nov. 13, 2003

(51) Int. Cl.[7] ..... H02P 9/04
(52) U.S. Cl. ..... 290/1 R; 219/211; 322/3
(58) Field of Search ..... 290/1 R, 1 A; 322/3, 4, 9; 219/211

(56) References Cited

U.S. PATENT DOCUMENTS 4,674,199 A * 6/1987 Lakic ..... 36/2.6
4,782,602 A * 11/1988 Lakic ..... 36/2.6
4,845,338 A * 7/1989 Lakic ..... 219/211
6,239,501 B1 * 5/2001 Komarechka ..... 290/1 R
6,255,799 B1 * 7/2001 Le et al. ..... 320/107
6,281,594 B1 * 8/2001 Sarich ..... 290/1 R

* cited by examiner

*Primary Examiner*—Nicholas Ponomarenko
(74) *Attorney, Agent, or Firm*—Cook, Alex, McFarron, Manzo, Cummings & Mehler, Ltd.

(57) ABSTRACT

A footwear includes an outsole defining a reference plane, a stand projecting from the outsole and having an inclined upper surface that is inclined relative to the reference plane, a power generator mounted on the outsole and including a rotor, and a driving unit including a weight that has a pivot end mounted pivotally on the inclined upper surface, and a free end opposite to the pivot end. The weight is connected to the rotor, and is swingable by virtue of gravity as a result of swinging of the inclined upper surface of the stand so as to drive the rotor.

4 Claims, 11 Drawing Sheets

FOOTWEAR WITH A POWER GENERATOR

BACKGROUND OF THE INVENTION

1. Field of the Invention

This invention relates to a footwear with a power generator, more particularly to a footwear with a power generator for activating a light source in a cavity between an outsole and an upper of the footwear.

2. Description of the Related Art

FIGS. 1 and 2 illustrate a conventional footwear with a battery 123 for a light source 125 in a cavity in a sole 111 of the footwear. The footwear includes a pressing member 124 that is pressable to electrically connect the battery 123 and the light source 125 when an external force is applied to the pressing member 124 so as to permit the light source 125 to generate flashing light when the user is walking.

The conventional footwear is disadvantageous in that it is relatively expensive to use the battery 123 for activating the light source 125.

SUMMARY OF THE INVENTION

Therefore, the object of the present invention is to provide a footwear that is capable of overcoming the aforesaid drawback.

According to the present invention, there is provided a footwear that comprises: an outsole having a heel portion and defining a reference plane that is adapted to form an angle with a ground surface when the heel portion is lifted above the ground surface and that is adapted to be parallel to the ground surface when the heel portion is in contact with the ground surface; a stand projecting upwardly from the outsole and having an inclined upper surface that is inclined relative to the reference plane; a power generator mounted on the outsole and including a rotor that is rotatable about an axis, and a stator magnetically associated with the rotor for generating power upon rotation of the rotor; and a driving unit including a weight that has a pivot end mounted pivotally on the inclined upper surface, and a free end opposite to the pivot end, and that is connected to the rotor. The free end of the weight is swingable by virtue of gravity when the inclined upper surface of the stand is swung back and forth as a result of upward and downward movements of the heel portion within the angle, thereby driving the rotor to rotate back and forth so as to permit actuation of the power generator to generate power.

BRIEF DESCRIPTION OF THE DRAWINGS

In drawings which illustrate embodiments of the invention.

DETAILED DESCRIPTION OF THE PREFERRED EMBODIMENTS

Figure 1:
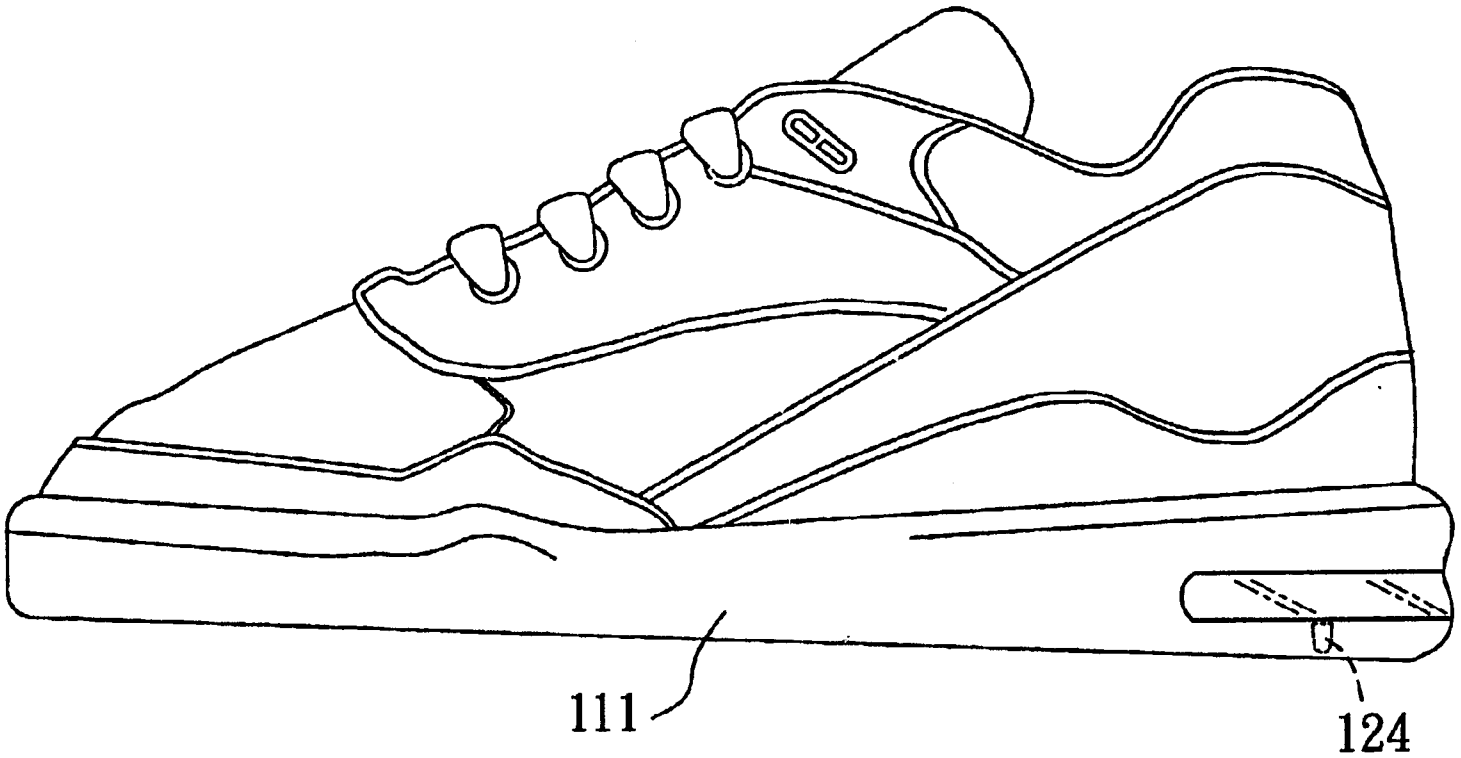
FIG. 1 PRIOR ART
FIG. 1 is a schematic side view of a conventional footwear.
Figure 2:
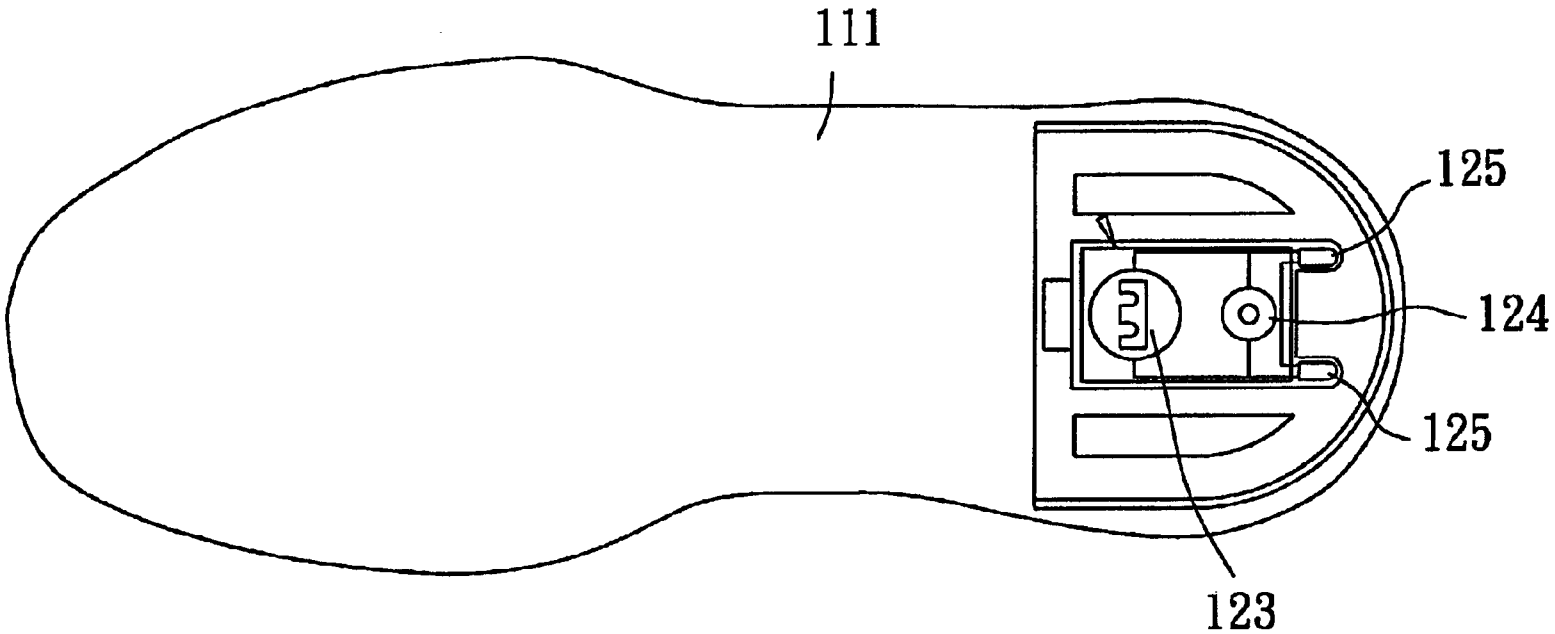
FIG. 2 PRIOR ART
FIG. 2 is a bottom view to illustrate how a pressing member functions to electrically connect a battery and a light source in a cavity in the footwear of FIG. 1.
Figure 3:
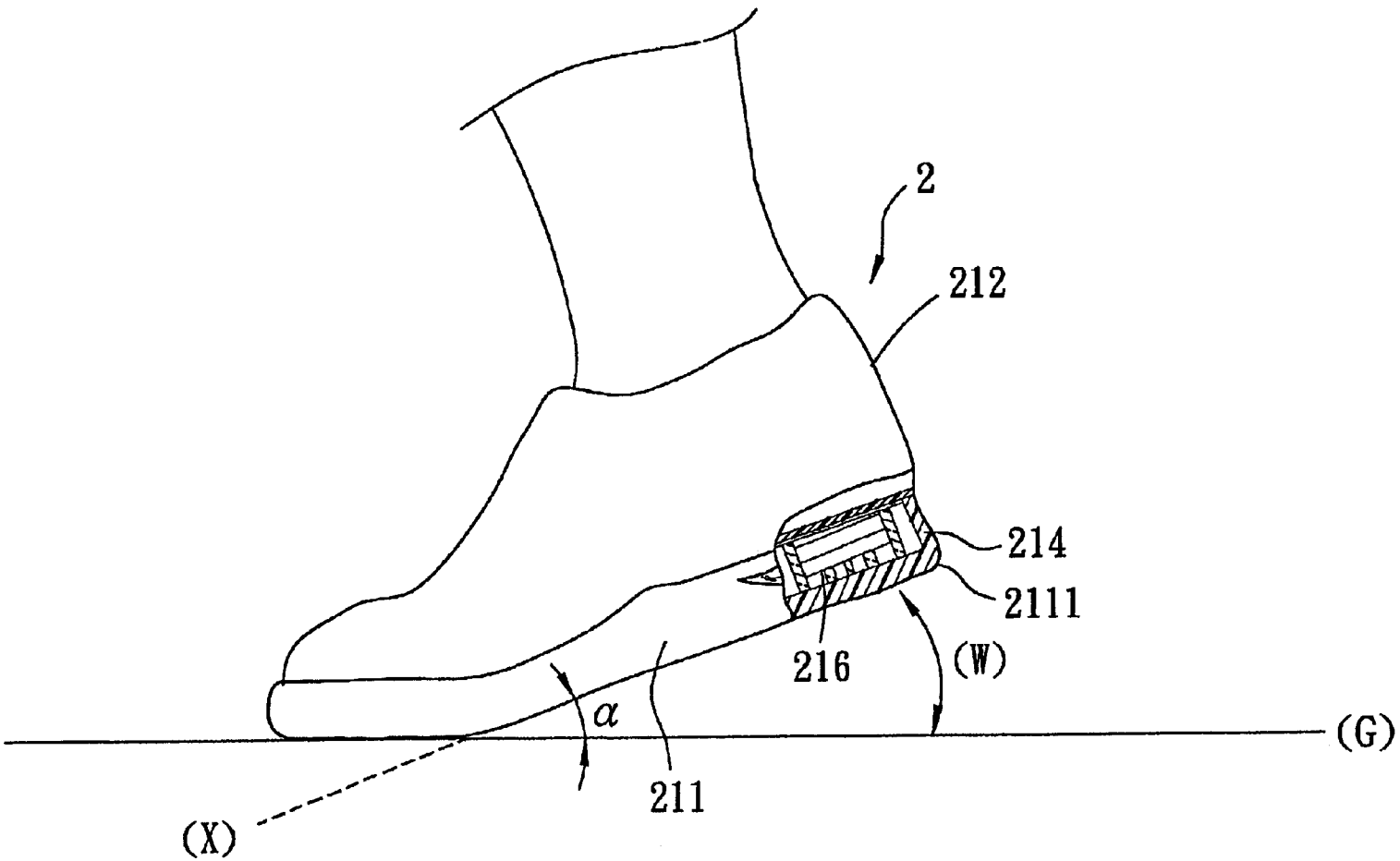
FIG. 3 is a schematic partly cutaway view of a preferred embodiment of a footwear of this invention.
Figure 4:
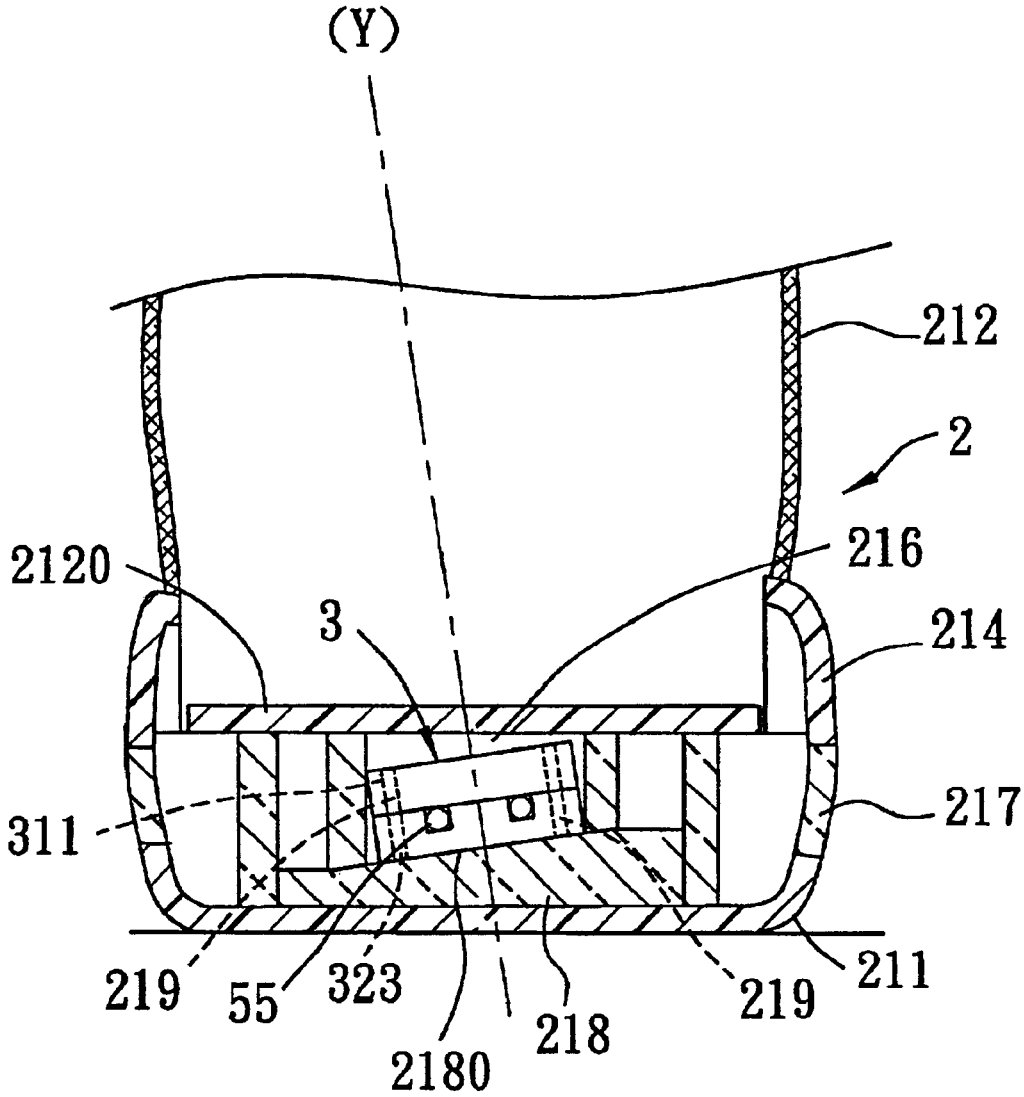
FIG. 4 is a rear sectional view to illustrate how a casing with a light source is mounted on an inclined upper surface of a stand in a cavity in the footwear of FIG. 3.
Figure 5:
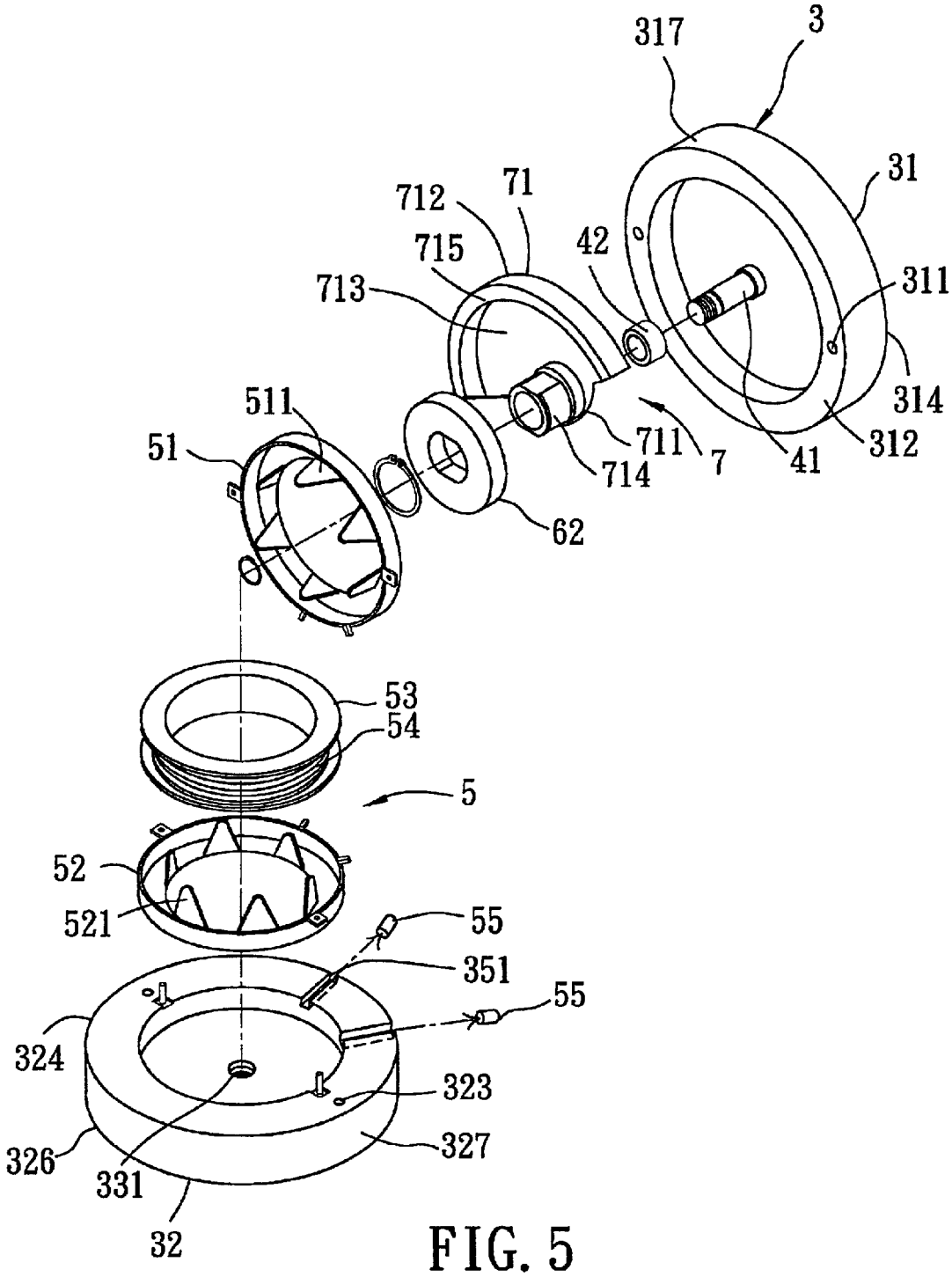
FIG. 5 is an exploded perspective view of a power generator with a driving unit mounted in the casing of FIG. 4.
Figure 6:
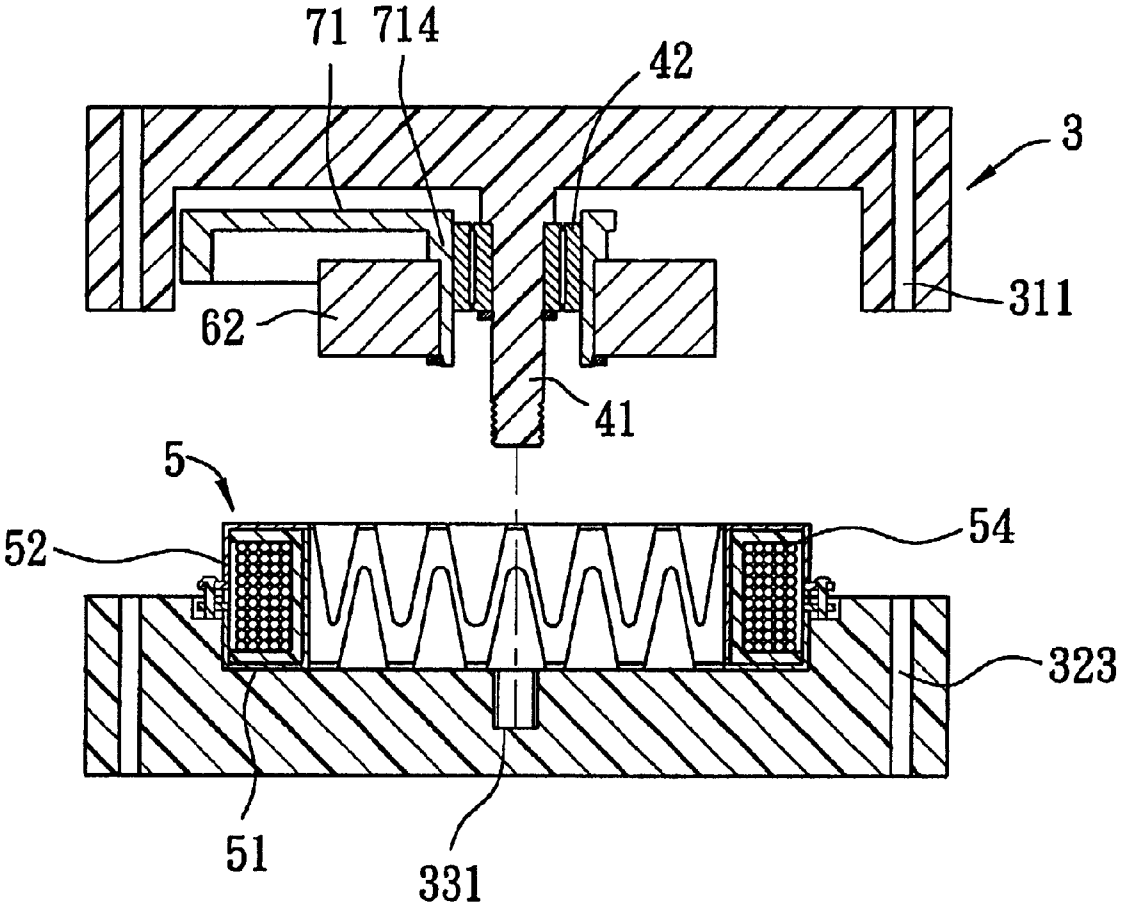
FIG. 6 is a partly exploded sectional view to illustrate how the power generator is connected to the driving unit.
Figure 7:
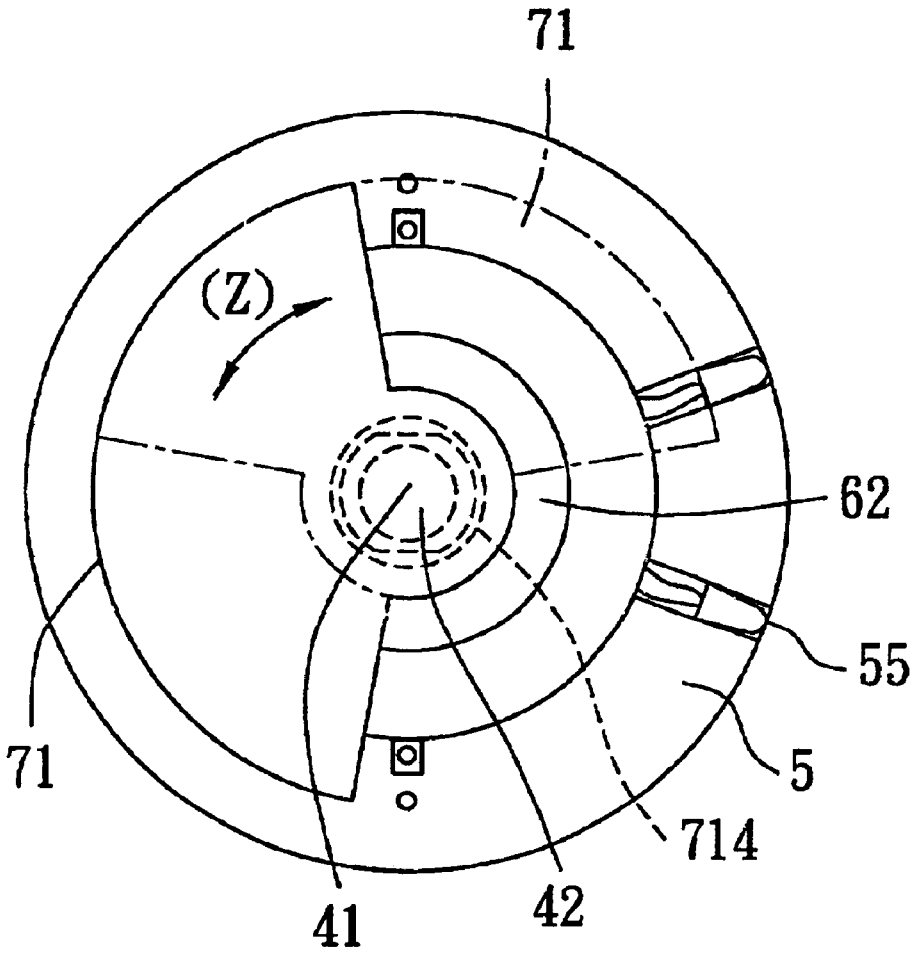
FIG. 7 is a top view to illustrate how the driving unit rotates in response to an inclining action of the inclined upper surface.

FIGS. 3 to 7 illustrate a first preferred embodiment of the footwear 2 of this invention.

The footwear 2 includes: an outsole 211 having a heel portion 2111 and defining a reference plane (X) that is adapted to form an angle ($\alpha$) with a ground surface (G) when the heel portion 2111 is lifted above the ground surface (G) and that is adapted to be parallel to the ground surface (G) when the heel portion 2111 is in contact with the ground surface (G); an upper 212 that is connected to the outsole 211 via a flange 214 and that has an insole 2120 cooperating with the outsole 211 and the flange 214 to define a cavity 216 thereamong; a stand 218 projecting upwardly from the outsole 211 into the cavity 216 and having an inclined upper surface 2180 that is inclined relative to the reference plane (X); a power generator mounted on the outsole 211 and including a rotor 6 that is rotatable about an axis (Y) which is perpendicular to the inclined upper surface 2180, and a stator 5 magnetically associated with the rotor 62 for generating power upon rotation of the rotor 62; and a driving unit 7 including a weight 71 that has a pivot end 711 mounted pivotally on the inclined upper surface 2180, and a free end 712 opposite to the pivot end 711, and that is connected to the rotor 62. The free end of the weight 71 is swingable in a direction (indicated by reference numeral (Z) in FIG. 7) by virtue of gravity when the inclined upper surface 2180 of the stand 218 is swung back and forth in a direction (indicated by reference numeral (W) in FIG. 3) as a result of upward and downward movements of the heel portion 2111 within the angle ($\alpha$), thereby driving the rotor 62 to rotate back and forth so as to permit actuation of the power generator to generate power.

A casing 3 is disposed in the cavity 216, is securely mounted on the inclined upper surface 2180 of the stand 218, and includes cylindrical upper and lower halves 31, 32 that confine a mounting space therebetween. Each of the upper and lower halves 31, 32 has an open end 312 (324) and a closed end 314 (326) that is opposite to the open end 312 (324) and that has a center. The center of the closed end 326 of the lower half 32 is formed with a threaded hole 331 in communication with the mounting space. A pivot shaft 41 projects from the center of the closed end 314 of the upper half 31 into the mounting space, and threadedly engages the threaded hole 33. A bearing 42 is securely sleeved on the pivot shaft 41. The weight 71 has a sector-shaped plate portion 713 that has opposite inner and outer ends, a sleeve portion 714 that projects from the inner end of the plate portion 713 in an axial direction relative to the plate portion 713 and that defines the pivot end 711 of the weight 71, and a flange portion 715 that projects from the outer end of the plate portion 713 in the axial direction and that defines the free end 712 of the weight 71. The sleeve portion 714 is rotatably sleeved on the bearing 42 so as to permit free swinging of the weight 71 about the pivot shaft 41. The rotor 62 is coaxially and securely mounted on the sleeve portion 714 so as to permit co-rotation therewith about the pivot shaft 41.

The open end 324 of the lower half 32 has an end face that is formed with a pair of radial grooves 351. A pair of light sources 55 are mounted in the radial grooves 351, respectively, and are electrically connected to the stator 5 of the power generator so as to emit light when the power generator is actuated by the driving unit 7. The flange 214 of the footwear 2 has a transparent portion 217 that is horizontally registered with the radial grooves 351 so as to permit penetration of light from the light sources 55 therethrough.

Each of the upper and lower halves 31, 32 has an annular peripheral portion 317 (327) that extends between the open end 312 (324) and the closed end 314 (326) and that is formed with a pair of opposing slots 311 (323) extending between the open end 312 (324) and the closed end 314 (326). The stand 218 is formed with a pair of locking pins 219 that project upwardly from the inclined upper surface 2180 and that are fittingly and respectively inserted into the slots 311, 323 in the peripheral portions 317 (327) of the upper and lower halves 31, 32 so as to permit positioning of the casing 3 on the stand 218.

The stator 5 is disposed in the mounting space in the casing 3, and includes conductive upper and lower rings 51, 52, a reel 53, and a conductive coil 54 wound around the reel 53 and electrically connected to the upper and lower rings 51, 52. Each of the upper and lower rings 51, 52 is formed with a plurality of angularly spaced apart teeth 511 (521) The rotor 62 is surrounded by the teeth 511, 521 of the upper and lower rings 51, 52, and includes a plurality of sector-shaped magnetic pieces (not shown) which are arranged along a circle. An electric current is generated and passes through the upper and lower rings 51, 52, the coil 53, and the light sources 55 when the rotor 62 rotates about the axis (Y).

Figure 8:
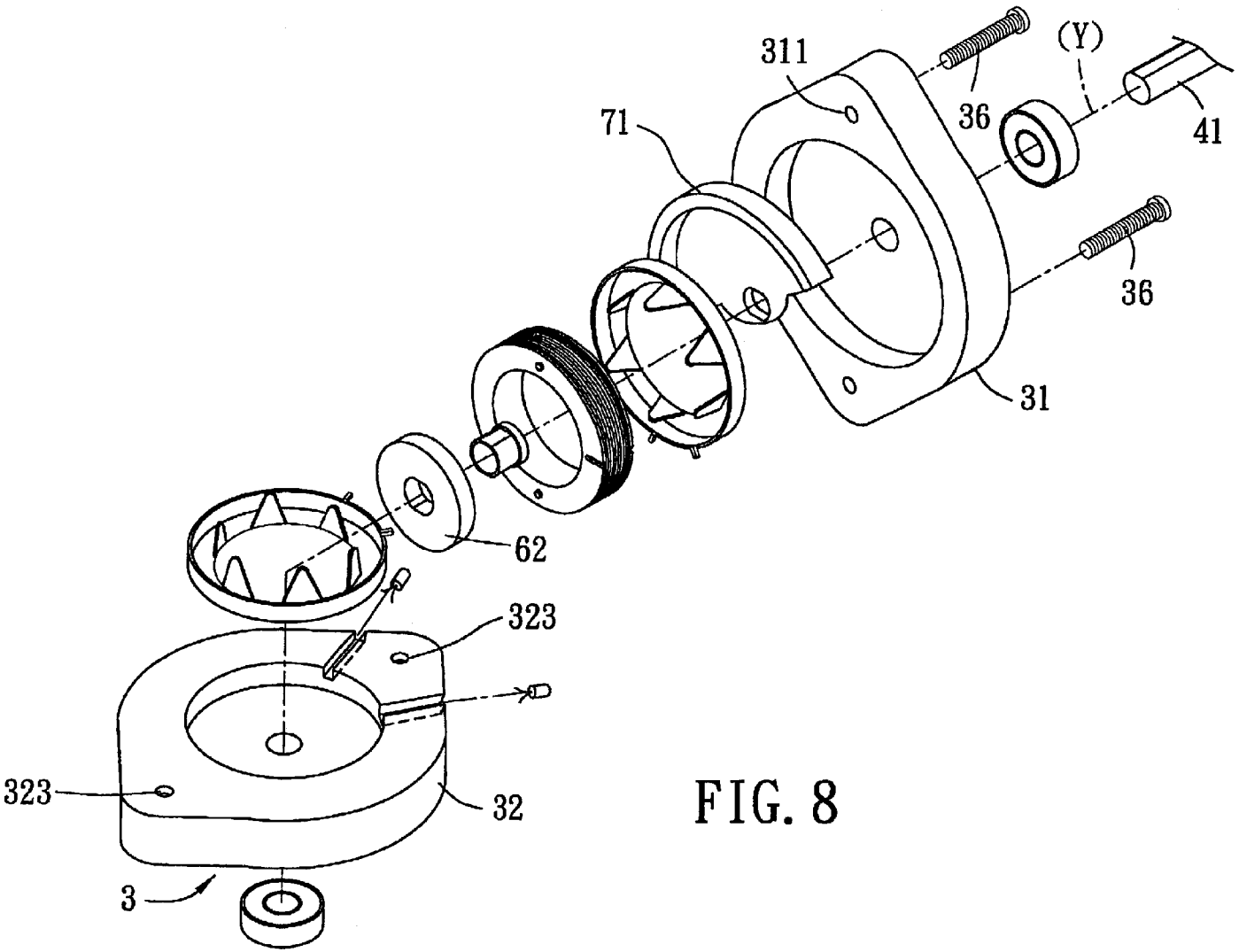
FIG. 8 is a fragmentary exploded perspective view of a second preferred embodiment of the footwear of this invention.
Figure 9:
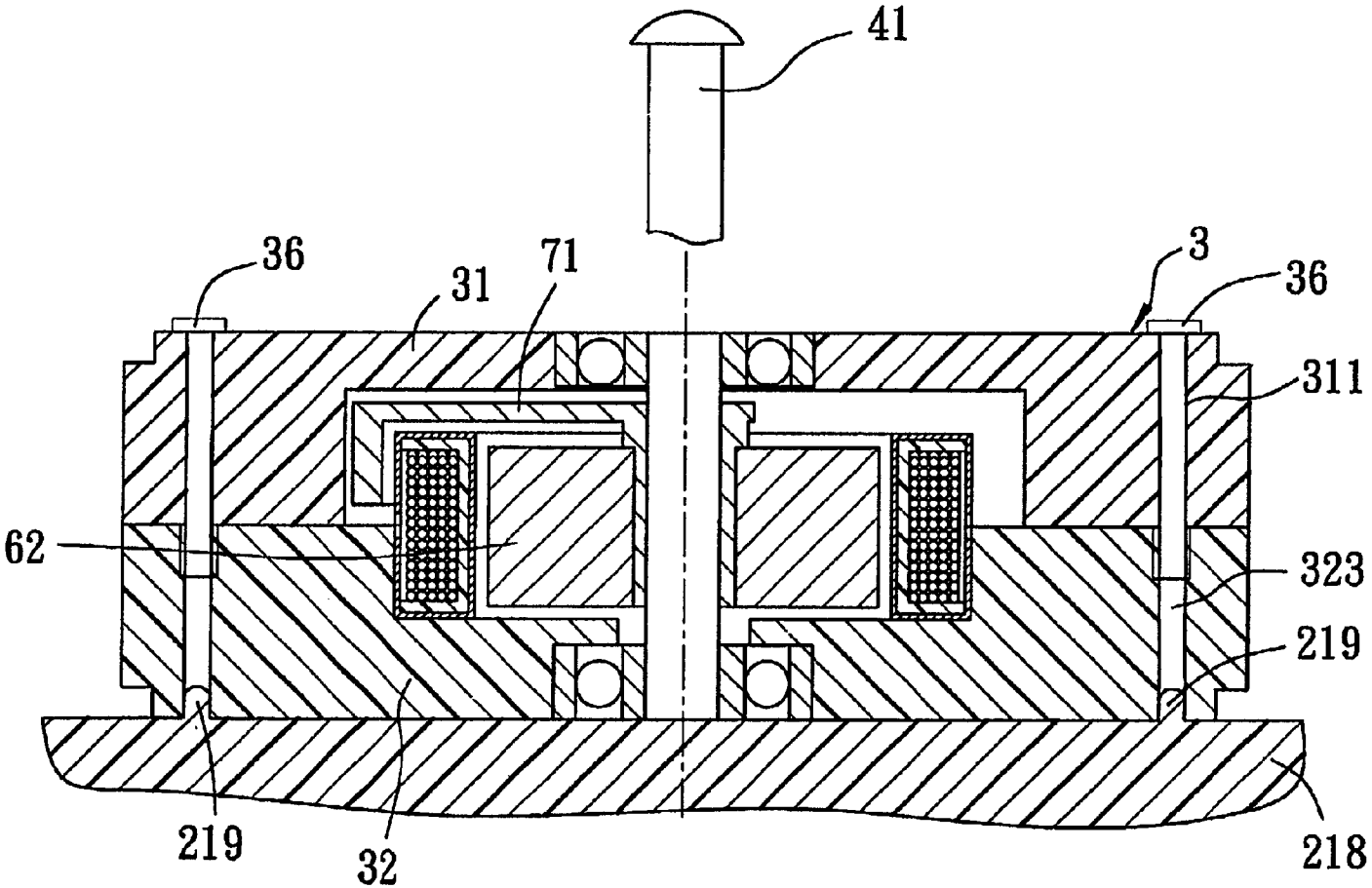
FIG. 9 is a sectional view to illustrate how the power generator is connected to the driving unit of the footwear of FIG. 8.

FIGS. 8 and 9 illustrate a second preferred embodiment of the footwear 2 of this invention which is similar to the first embodiment, except that the pivot shaft 41 in this embodiment is a separate piece from the upper half 31 of the casing 3, and is co-rotatable with the weight 71 and the rotor 62 about the axis (Y), and that the locking pins 219 are only inserted into the slots 323 in the lower half 32 of the casing 3. Moreover, a pair of screw bolts 36 are inserted into the slots 311 in the upper half 31 of the casing 3, and threadedly engage threaded ends of the slots 323 in the lower half 32 of the casing 3.

Figure 10:
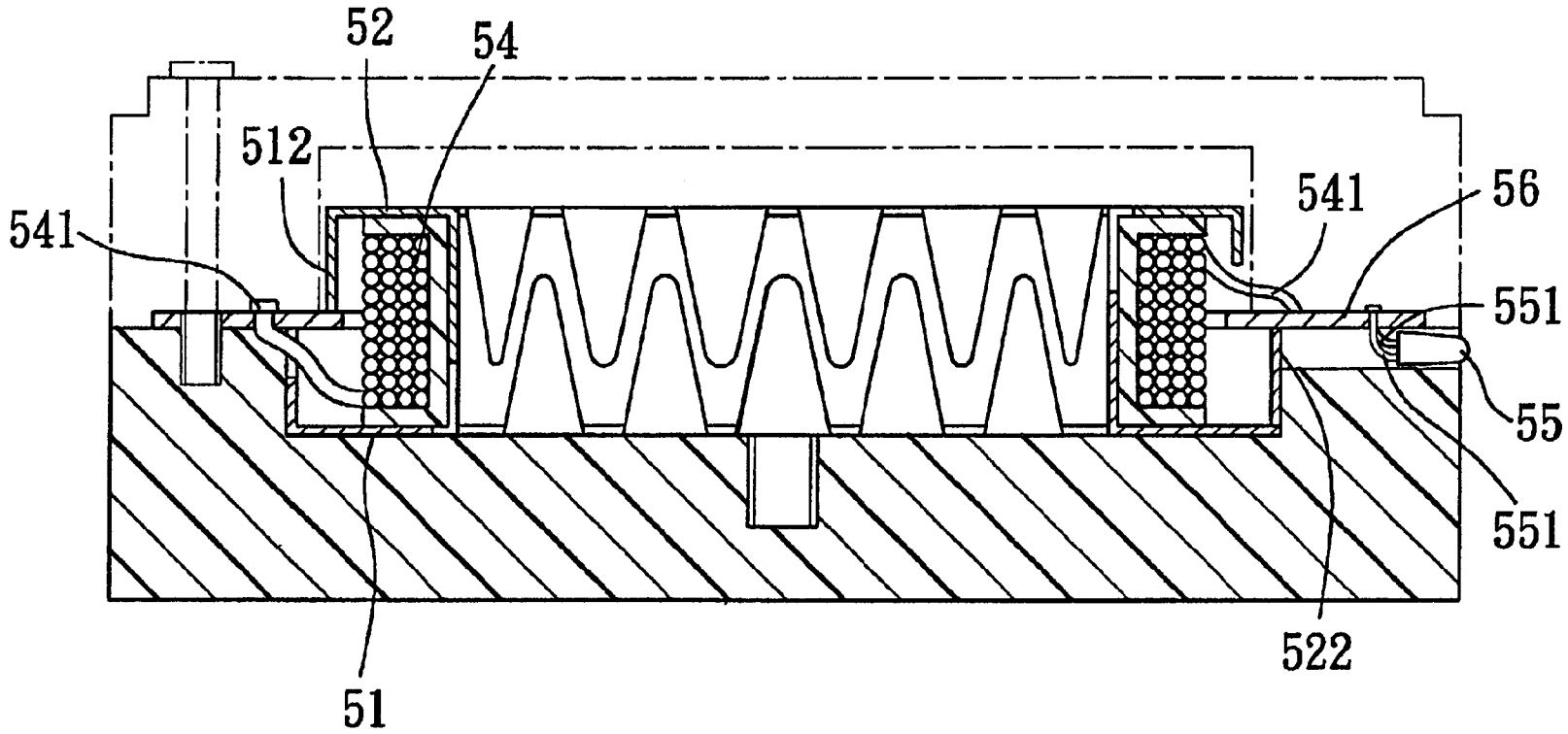
FIG. 10 is a sectional view to illustrate how a light source is connected to a power generator via a printed circuit plate of a third preferred embodiment of the footwear of this invention.
Figure 11:
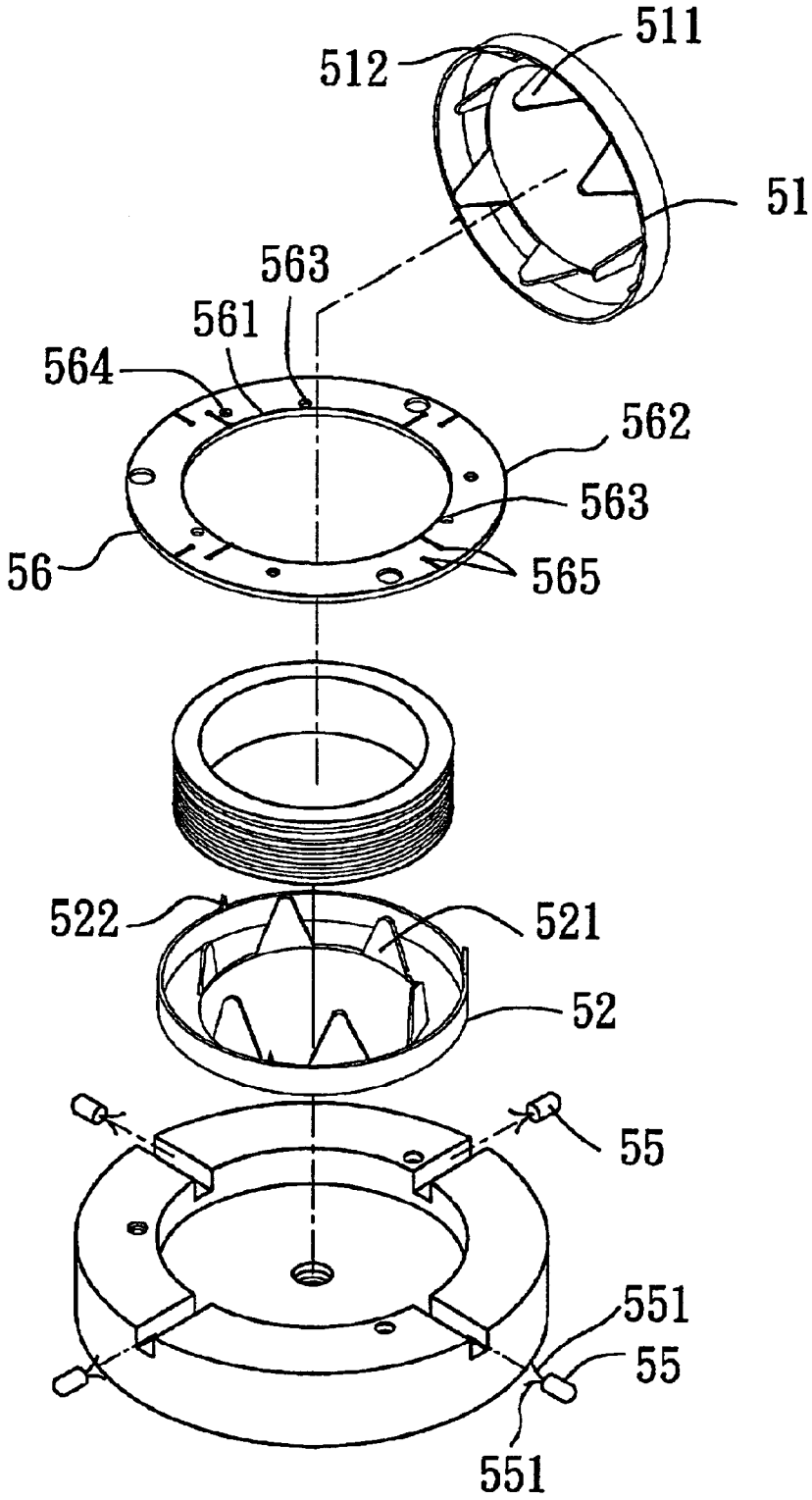
FIG. 11 is an exploded perspective view of an assembly of the light source, the power generator, and the printed circuit plate of FIG. 10.

FIGS. 10 and 11 illustrate a third embodiment of the footwear of this invention, which is similar to the previous embodiments, except that an annular printed circuit plate 56 is used to electrically connect the light sources 55, the coil 34, and the upper and lower rings 51, 52. The annular printed circuit plate 56 has inner and outer end faces 561, 562 which are coated with a conductive material, and is formed with a plurality of first insertion holes 563 which are respectively confined by first hole-confining walls that are coated with a conductive material and that are electrically connected to the inner end face 561, a plurality of second insertion holes 564 which are respectively confined by second hole-confining walls that are coated with a conductive material and that are electrically connected to the outer end face 562, and a plurality of third insertion holes 565 which are respectively confined by third hole-confining walls that are coated with a conductive material. Two adjacent ones of the third insertion holes 565 form a pair for insertion of legs 551 of a respective light source 55. One of the two adjacent ones of the third insertion holes 565 is electrically connected to the inner end face 561, and the other one is electrically connected to the outer end face 562. The upper ring 51 is formed with a plurality of angularly spaced apart legs 512 that are inserted into the first insertion holes 563, respectively. The lower ring 52 is formed with a plurality of angularly spaced apart legs 522 that are inserted into the second insertion holes 564, respectively. The coil 54 has two opposite ends 541 that are electrically and respectively connected to the inner and outer end faces 561, 562. The inclusion of the printed circuit plate 56 facilitates electrical connection among the upper and lower rings 51, 52, the coil 53, and the light sources 55.

With the design of the inclined surface 2180 of the stand 218 and the inclusion of the driving unit 7 and the power generator, the aforesaid battery employed in the prior art can be eliminated.

With the invention thus explained, it is apparent that various modifications and variations can be made without departing from the spirit of the present invention. It is therefore intended that the invention be limited only as recited in the appended claims.

I claim:

1. A footwear comprising:

an outsole having a heel portion and defining a reference plane that is adapted to form an angle with a ground surface when said heel portion is lifted above the ground surface and that is adapted to be parallel to the ground surface when said heel portion is in contact with the ground surface;

a stand projecting upwardly from said outsole and having an inclined upper surface that is inclined relative to the reference plane;

a power generator mounted on said outsole and including a rotor that is rotatable about an axis, and a stator magnetically associated with said rotor for generating power upon rotation of said rotor; and a driving unit including a weight that has a pivot end mounted pivotally on said inclined upper surface, and a free end opposite to said pivot end, and that is connected to said rotor, said free end of said weight being swingable by virtue of gravity when said inclined upper surface of said stand is swung back and forth as a result of upward and downward movements of said heel portion within said angle, thereby driving said rotor to rotate back and forth so as to permit actuation of said power generator to generate power.

2. The footwear of claim 1, further comprising an upper that has an insole cooperating with said outsole to define a cavity therebetween, a casing, a pivot shaft, and a bearing, said stand being disposed in said cavity, said casing being securely mounted on said inclined upper surface of said stand and including cylindrical upper and lower halves that confine a mounting space therebetween, each of said upper and lower halves having an open end and a closed end that is opposite to said open end and that has a center, said center of said closed end of said lower half being formed with a threaded hole in communication with said mounting space, said pivot shaft projecting from said center of said closed end of said upper half into said mounting space and threadedly engaging said threaded hole, said bearing being securely sleeved on said pivot shaft, said weight having a sector-shaped plate portion that has opposite inner and outer ends, a sleeve portion that projects from said inner end of said plate portion in an axial direction relative to said plate portion and that defines said pivot end of said weight, and a flange portion that projects from said outer end of said plate portion in said axial direction and that defines said free end of said weight, said sleeve portion being rotatably sleeved on said bearing so as to permit free swinging of said weight about said pivot shaft, said rotor being coaxially and securely mounted on said sleeve portion so as to permit co-rotation therewith about said pivot shaft.

3. The footwear of claim 2, wherein said open end of said lower half of said casing has an end face that is formed with a radial groove, said footwear further comprising a light source that is mounted in said radial groove and that is electrically connected to said power generator.

4. The footwear of claim 2, wherein each of said upper and lower halves of said casing has an annular peripheral portion that extends between said open end and said closed end and that is formed with a pair of opposing slots extending between said open end and said closed end, said stand being formed with a pair of locking pins that project upwardly from said inclined upper surface and that are fittingly and respectively inserted into said slots in said peripheral portions of said upper and lower halves so as to permit positioning of said casing on said stand.

* * * * *